US011623851B2

(12) United States Patent
Kastello

(10) Patent No.: US 11,623,851 B2
(45) Date of Patent: Apr. 11, 2023

(54) STAKE EXTRACTION DEVICE AND METHOD

(71) Applicant: Kyle Kastello, Billings, MT (US)

(72) Inventor: Kyle Kastello, Billings, MT (US)

( * ) Notice: Subject to any disclaimer, the term of this patent is extended or adjusted under 35 U.S.C. 154(b) by 335 days.

(21) Appl. No.: 16/927,842

(22) Filed: Jul. 13, 2020

(65) Prior Publication Data

US 2021/0108437 A1 Apr. 15, 2021

Related U.S. Application Data

(60) Provisional application No. 62/913,999, filed on Oct. 11, 2019.

(51) Int. Cl.
*E04H 17/26* (2006.01)
*B66F 15/00* (2006.01)

(52) U.S. Cl.
CPC ..... *B66F 15/00* (2013.01); *E04H 17/265* (2013.01)

(58) Field of Classification Search
CPC ..... E04H 17/265; B66F 15/00
See application file for complete search history.

(56) References Cited

U.S. PATENT DOCUMENTS

| | | | | |
|---|---|---|---|---|
| 10,351,404 | B1 * | 7/2019 | Sanford | B66F 15/00 |
| 11,214,977 | B2 * | 1/2022 | Martin | E04H 17/265 |
| 2017/0058559 | A1 * | 3/2017 | Martin | E04H 17/263 |
| 2021/0108437 | A1 * | 4/2021 | Kastello | E04H 17/265 |

* cited by examiner

*Primary Examiner* — Andrew J Triggs
(74) *Attorney, Agent, or Firm* — Mark A. Goodman, Esq.

(57) ABSTRACT

Devices and methods for extracting objects from substrates are disclosed. One embodiment has a first end with a tapered handle and a second end with a dowel. The dowel can be a steel dowel and include a beveled edge enabling engagement with a hole in an object. Another embodiment can include an intermediate portion connected to and located between the first and second ends. The device can be manually inserted into a hole in a stake. Once engaged with the stake, a user can apply torque in a clockwise or counterclockwise direction several times to loosen the stake from the substrate. When loosened from the substrate, a user can apply a pulling force away from the substrate to remove the stake.

7 Claims, 5 Drawing Sheets

STAKE EXTRACTION DEVICE AND METHOD

CROSS-REFERENCE TO RELATED APPLICATIONS

This is a Nonprovisional Utility U.S. Patent Application under 37 CFR 1.53(b). This application claims the benefit of U.S. Provisional Patent Application No. 62/913,999, filed Oct. 11, 2019.

BACKGROUND OF THE INVENTION

1. Field of the Invention

The present invention relates generally to devices for extracting objects from substrates. More particularly, the present invention relates to devices and methods for extracting stakes from the ground.

2. Description of Related Art

Extraction of stakes from substrates can be a labor-intensive process. One technique requires manually removing a stake using a sledgehammer by repeatedly striking a side until the stake loosens from the substrate. The sledgehammer technique is tedious and requires a user to carry the heavy and bulky tool. Another technique involves use of a powered machine to remove a stake, such as a hydraulically powered device. Disadvantages of using a powered machine are the excessive size and costs. There is a need in the field for a portable and efficient device for manually extracting stakes from substrates. Another example solutions consist of tools that use manual leverage to remove the stakes. The disadvantage of these tools is that they are bulky and difficult to transport. These tools would certainly not fit in a standard toolbox.

SUMMARY OF THE INVENTION

Devices for extracting objects (e.g. stakes) from substrates are disclosed herein. One embodiment has a first end with a tapered handle and a second end with a dowel. The first end can be constructed of wood, plastic, or another lightweight material. The dowel can be a steel dowel and include a beveled edge enabling engagement with a hole in an object. Another embodiment can include an intermediate portion operably connected to and located between the first and second ends.

Further, methods for extracting objects from substrates are disclosed. A device can be manually inserted into a hole in a stake. Once engaged with the stake, a user can apply torque in a clockwise or counterclockwise direction several times to loosen the stake from the substrate. When loosened from the substrate, a user can apply a pulling force away from the substrate to remove the stake.

These and other features and advantages will be apparent from reading of the following detailed description and review of the associated drawings. It is to be understood that both the forgoing general description and the following detailed description are explanatory and do not restrict aspects as claimed.

DETAILED DESCRIPTION OF EMBODIMENTS

The following descriptions relate principally to preferred embodiments while a few alternative embodiments may also be referenced on occasion, although many other alternative embodiments would also fall within the scope of the invention. The embodiments disclosed are not to be construed as describing limits to the invention, whereas the broader scope of the invention should instead be considered with reference to the claims, which may be now appended or may later be added or amended in this or related applications. Unless indicated otherwise, it is to be understood that terms used in these descriptions generally have the same meanings as those that would be understood by persons of ordinary skill in the art. It should also be understood that terms used are generally intended to have the ordinary meanings that would be understood within the context of the related art, and they generally should not be restricted to formal or ideal definitions, conceptually encompassing equivalents, unless and only to the extent that a particular context clearly requires otherwise. In light of the present disclosure, those of ordinary skill in the art should also appreciate that many changes can be made relative to the disclosed embodiments while still obtaining a comparable function or result without departing from the spirit and scope of the disclosure.

For purposes of these descriptions, a few wording simplifications should also be understood as universal, except to the extent otherwise clarified in a particular context either in the specification or in particular claims. The use of the term "or" should be understood as referring to alternatives, although it is generally used to mean "and/or" unless explicitly indicated to refer to alternatives only, or unless the alternatives are inherently mutually exclusive. Furthermore, unless explicitly dictated by the language, the term "and" may be interpreted as "or" in some instances. When referencing values, the term "about" may be used to indicate an approximate value, generally one that could be read as being that value plus or minus half of the value. "A" or "an" and the like may mean one or more, unless clearly indicated otherwise. Such "one or more" meanings are most especially intended when references are made in conjunction with open-ended words such as "having," "comprising" or "including." Likewise, "another" object may mean at least a second object or more. Thus, in the context of this specification, the term "comprising" is used in an inclusive sense and thus should be understood as meaning "including, but not limited to." As used herein, the use of "may" or "may be" indicates that a modified term is appropriate, capable, or suitable for an indicated capacity, function, or usage, while considering that in some circumstances the modified term may sometimes not be appropriate, capable, or suitable.

Figure 1:
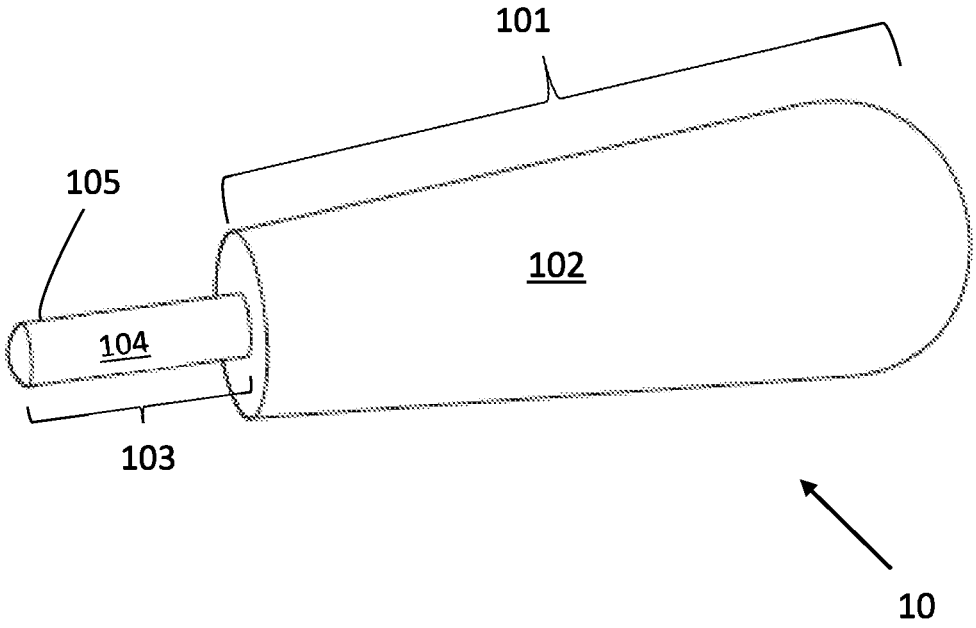
FIG. 1 illustrates an embodiment of a device for extracting an object from a substrate.

FIG. 1 illustrates an embodiment of a device 10 for manually extracting an object from a substrate. The device 10 includes a first end 101 which can include a tapered handle 102. The tapered handle 102 enables the first end 101 to be lightweight and durable, while also allowing a user to establish a firm grip. The first end 101 can be constructed of a wooden material, a plastic material, or a lightweight metal.

The first end 101 can have different lengths but an example embodiment has a length of approximately 3.5 inches. A second end 103 connects to the first end 101. The second end 103 can be affixed to the first end 101 using threaded fastening, an adhesive, welding, or other means of mechanical attachment. The second end 103 can have various lengths and diameters but an example embodiment has an approximate length of 0.7 inches with a diameter of 0.18 inches. As shown, the diameter of the tapered handle 102 of the first end 101 decreases so that the handle 102 is narrower at the point of connection with the second end 103. The second end 103 includes a dowel 104 with a beveled edge 105. A beveled edge 105 enables the dowel 104 to be engaged with hole in an object without becoming caught in the object during entry and/or removal of the dowel 104. The dowel 104 is preferably constructed of metal but can be constructed of wood, plastic, and the like. For example, the dowel 104 can be a high-speed steel dowel or a solid square stock steel bar.

Figure 2:
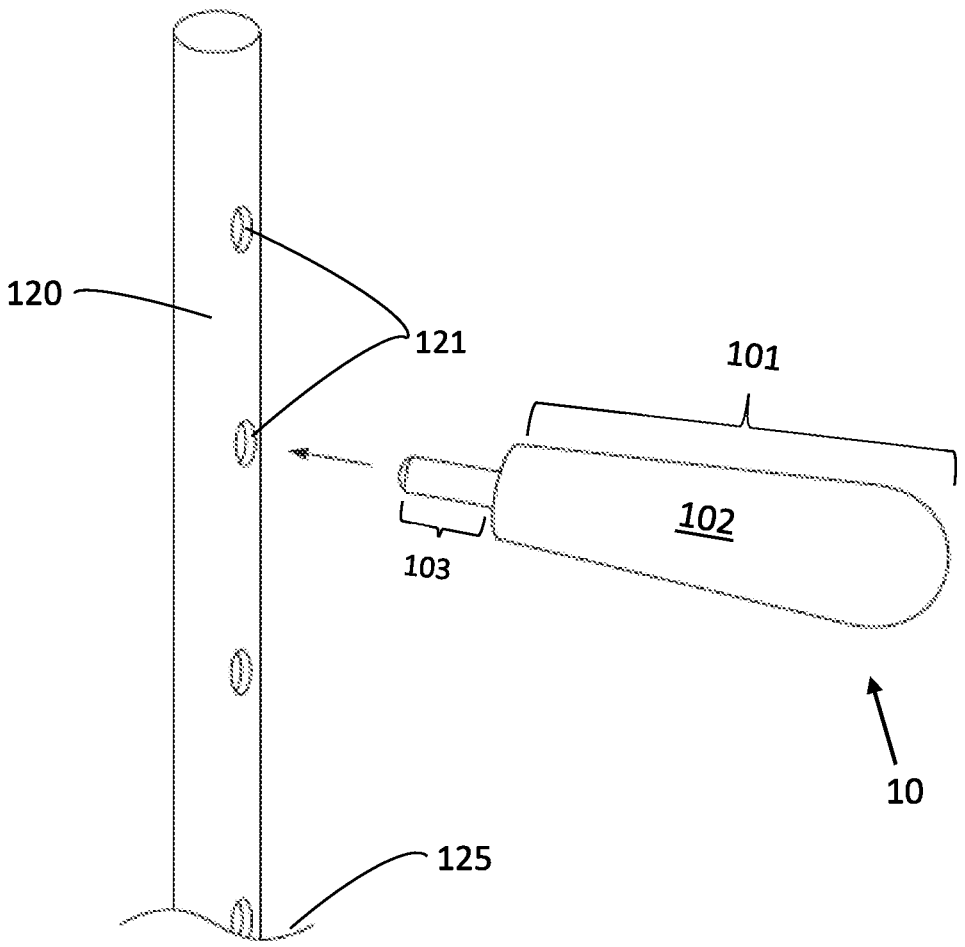
FIG. 2 illustrates a method of inserting the device into a hole of a stake.

FIG. 2 illustrates a method of inserting the device 10 into a hole 121 of an object 120. In this example, the object 120 is a stake. The device 10 can be described as a "stake removal device". In other embodiments, the object 120 could be a post or a similar support. The stake 120 is shown embedded into a substrate 125. The substrate 125 in this example is the ground, which can include soil, earth, sand, and the like. A user can grasp the tapered handle 102 of the first end 101. The user can then insert the second end 103 (dowel end) into a hole 121 of the stake 120. Holes 121 can be different shapes, including but not limited to: circular, oval, rectangular, square, and triangular. Although shown as cylindrical with a circular cross section in this example, the second end 103 can have various cross section shapes such as rectangular, triangular, circular, oval, and the like. Different shaped ends 103 can be implemented depending on the shape of the hole 121 or other opening.

Figure 3:
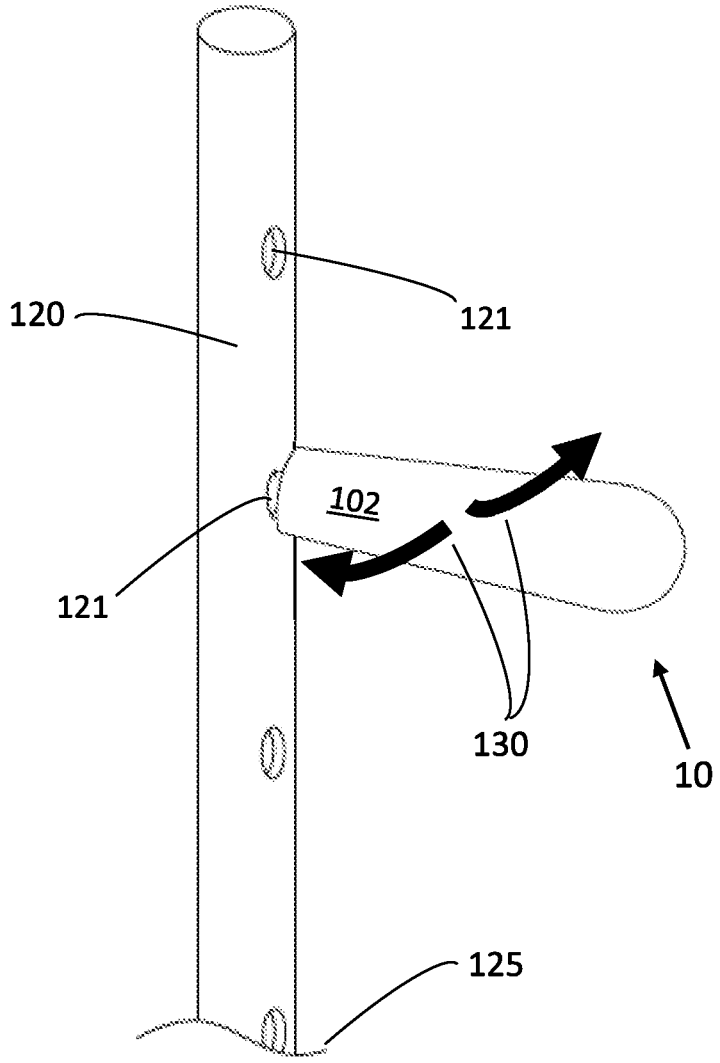
FIG. 3 illustrates a method of applying a torque to the device while engaged with a stake.

FIG. 3 illustrates a method of applying a torque 130 to the stake removal device 10 while the device 10 is inserted in a stake 120. Once the user has a firm grasp of the tapered handle 102, the user can apply a torque 130 to the device 10 in a clockwise or counterclockwise direction relative to the substrate 125. The user continues to apply torque 130 until the stake 120 is loosened from the substrate 125. The torque 130 can be applied in either direction initially, and the direction can be changed during the process of loosening the stake 120. For example, a user can initially apply torque 130 in a counterclockwise direction, then change to a clockwise direction, then back to counterclockwise, etc., until the stake 120 is loosened enough from the substrate 125 to enable removal.

Figure 4:
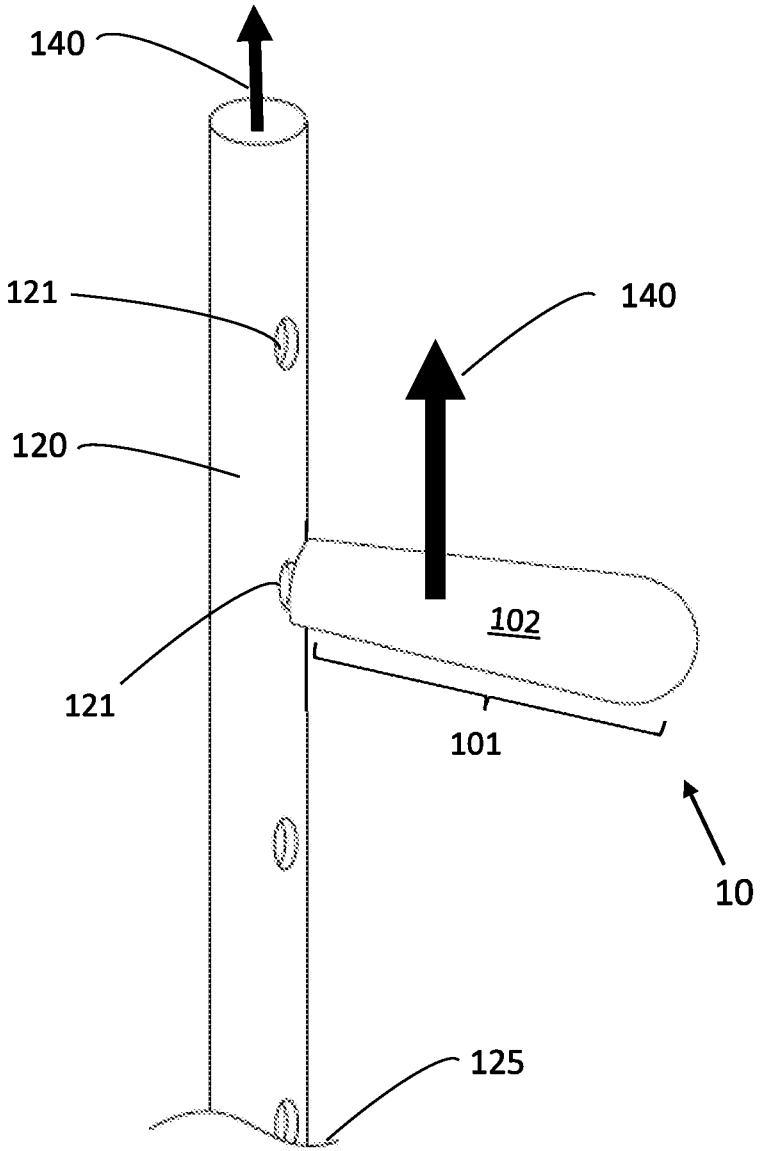
FIG. 4 illustrates a method of applying a pulling force to the device to remove a stake from a substrate.

FIG. 4 illustrates a method of applying a pulling force 140 to the device 10 to remove a stake 120 from a substrate 125. A user with a firm grasp of the tapered handle 102 of the first end 101 can apply the necessary force to remove the stake 120 which has been loosened from the substrate 125. A user can grasp the stake 120 and device 10 simultaneously while applying the pulling force 140. The pulling force 140 is applied in a direction away from the substrate 125. In this example, the pulling force 140 is applied in generally vertical direction relative to the substrate 125.

Figure 5:
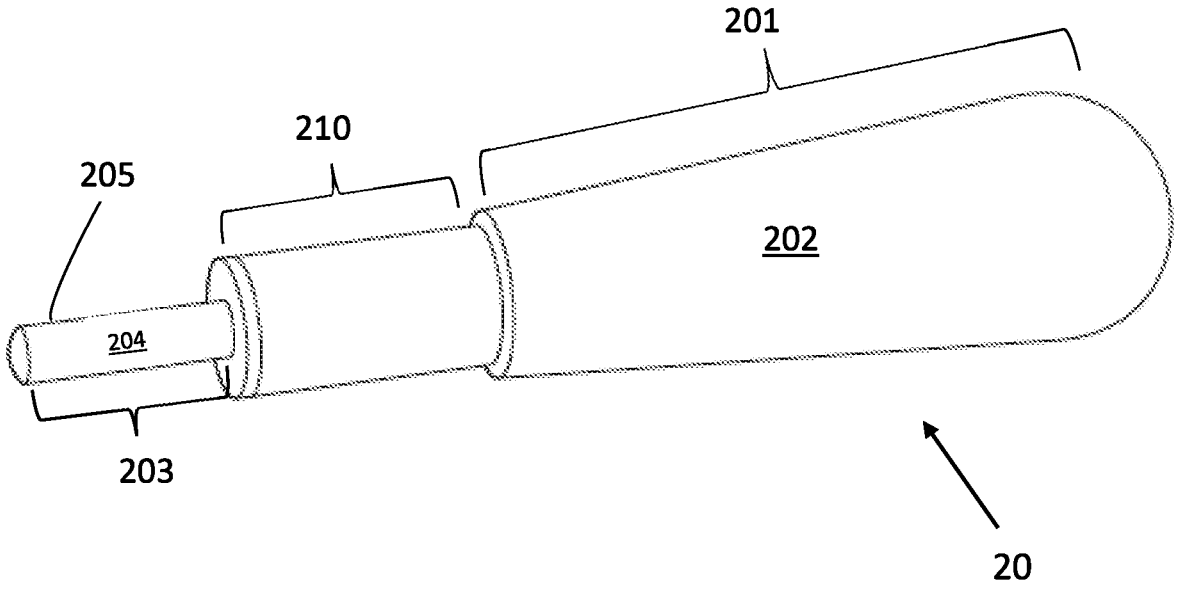
FIG. 5 illustrates an alternative embodiment of a device for extracting an object from a substrate.

FIG. 5 illustrates another embodiment of a device 20 for extracting an object from a substrate. The device 20 includes a first end 201 which includes a tapered handle 202. An intermediate portion 210 connects to the first end 201. The first end 201 can be constructed of a wooden material, a plastic material, or a lightweight metal. A second end 203 also connects to the intermediate portion 210. The first end 201 and the second end 203 can be affixed to the intermediate portion 210 using threaded fastening, an adhesive, welding, or other means of mechanical attachment. As shown, the diameter of the tapered handle 202 of the first end 201 decreases so that the handle 202 is narrower at the point of connection with the intermediate portion 210. This configuration helps prevent damage to the handle 202, which may be caused by the significant level of force applied to the dowel 204. The second end 203 includes a dowel 204 with a beveled edge 205. A beveled edge 205 enables the dowel 204 to be easily inserted into an object without becoming caught in the object during the entry and/or removal of the dowel 204. The dowel 204 is preferably constructed of metal but can be constructed of wood, plastic, and the like. For example, the dowel 204 can be a high-speed steel dowel or a solid square stock steel bar.

Similar methods can be implemented for extracting objects using the alternative device 20 as are described for extracting the other device 10. The differences in structure by adding an intermediate portion 210 do not fundamentally change the methods of extraction.

The invention claimed is:

1. A method for extraction of an object from a substrate comprising:

a. providing a stake removal device comprising a first end and a second end, wherein the first end comprises a tapered handle and the second end comprises a dowel having a beveled edge;

b. grasping the tapered handle of the first end;

c. inserting the second end into a hole in the object;

d. applying a torque to the stake removal device in a clockwise or counterclockwise direction relative to the substrate; and e. applying a pulling force to the stake removal device and removing the object from the substrate.

2. The method of claim 1 further comprising an intermediate portion in connection with the first end and the second end.

3. The method of claim 1 wherein the intermediate portion comprises a metal.

4. The method of claim 1 wherein the dowel is a high-speed steel dowel.

5. The method of claim 1, wherein the dowel comprises a solid square stock steel bar.

6. The method of claim 1 wherein the first end further comprises a wooden material.

7. The method of claim 1, wherein the first end further comprises a plastic material.

* * * * *